United States Patent [19]

Marcus

[11] 4,368,408

[45] Jan. 11, 1983

[54] TIME CONTROLLED LIGHT DIMMER

[76] Inventor: Edward Marcus, P.O. Box 5342, 6508 Pimlico Rd., Baltimore, Md. 21209

[21] Appl. No.: 284,507

[22] Filed: Jul. 17, 1981

[51] Int. Cl.[3] ..... H05B 37/02

[52] U.S. Cl. ..... 315/360; 340/309.1; 364/145; 364/569

[58] Field of Search ..... 364/569, 145; 315/360; 340/309.1

[56] References Cited

U.S. PATENT DOCUMENTS

| | | | |
|---|---|---|---|
| 1,964,846 | 7/1934 | Earnshaw | 315/360 |
| 3,299,401 | 1/1967 | Bolton | 340/309.1 |
| 4,217,646 | 8/1980 | Caltagirone et al. | 364/145 |

*Primary Examiner*—Harold A. Dixon

*Attorney, Agent, or Firm*—Berman, Aisenberg & Platt

[57] ABSTRACT

A method and apparatus for dimming traffic lights during hours of darkness to conserve energy. Electronic circuitry provides storage for weekly tables of twilight times for particular geographic locations covering an extended time period, such as one year. Counting apparatus counts weeks for addressing the stored tables, and an AM/PM indicator further differentiates between stored sunrise and sunset times. The stored time is compared in a comparator with the present time, and logic circuitry, responsive to the AM/PM indicator, reacts to the results of the comparison by activating and deactivating a dimmer for the traffic lights.

17 Claims, 4 Drawing Figures

TIME CONTROLLED LIGHT DIMMER

BACKGROUND OF THE INVENTION

1. Field of the Invention

This invention relates to light dimmers, and more particularly to devices for variably controlling the dimming of traffic lights in accordance with predetermined twilight schedules.

2. Background Art

It is known to use clock timers to control various electrical devices, such as lights, radios, and the like. Such devices typically suffer from the disadvantage of fixed times for turning devices on and off, and of failing to respond to varying requirements without manual supervision.

The use of light sensitive devices for controlling lighting apparatus to operate during times of darkness is known. However, such controls are known to suffer from a disadvantage of reliance on light conditions, so that the apparatus may be turned on during daylight hours, for example, as a result of cloudy atmospheric conditions.

There is no provision made in the prior art, however, for control of power consuming electrical apparatus in a reliable manner, in which electrical power supplied to the apparatus is automatically altered as a function of daylight times yet independently of actual light measurement.

SUMMARY AND OBJECTS OF THE INVENTION

It is accordingly a primary object of the present invention to provide a control device overcoming the disadvantages of the prior art.

It is a more specific object of the invention to provide a light dimmer for traffic lights, operative to dim such lights during the hours between sunset and sunrise.

Yet another object of the invention is the provision of a daylight controlled, yet light independent, device for dimming traffic lights, in which light sensitive control devices are not required.

Still a further object of the invention is the provision of an electronically operated control device for varying the power supplied to electrical devices in accordance with a stored time table having the operating times for an entire year stored therein.

It is an additional object of the invention to conserve electrical energy supplied to a device in accordance with a schedule for reduction of power supplied thereto, the schedule having variable times for such reduction being electronically stored.

Yet a further object of the invention is the provision of an economical method and apparatus for providing a variable control for power reduction in accordance with a predetermined schedule, in which one type of control is effected in one time segment (e.g., AM times) and another type of control is effected in another time segment (e.g., PM times), and in which a signal indicative of present time and time segment is compared with stored times in the schedule, the comparison taking different forms for the different time segments.

The present invention accordingly provides an electronic control circuit, including a storage device for a schedule of control times for an entire year, in which a comparison of the present time and stored time for a particular day is performed and evaluated in accordance with a determination of whether the present time is AM or PM. The invention provides circuitry for activating or deactivating a power reduction device in accordance with the results of the comparison. Moreover, the invention provides addressing circuitry for the storage device which is itself responsive to a signal indicative of whether the present time is AM or PM.

In accordance with other features of the invention, the circuitry includes a day counter and a week counter, the latter being used to address the storage device which includes therein a schedule of twilight times for a specific latitude for an entire year, stored as weekly twilight times. The day counter is responsive to generation of a transition between a PM signal and an AM signal, and itself is used to trigger the week counter.

A display means is provided for the electronic data used in the control circuit, and more specifically for the present time, the contents of the day counter, and the contents of the week counter. The data are multiplexed for display on a single display device.

The electronic device of the present invention is used for conserving electrical energy by dimming traffic lights in accordance with a predetermined schedule, determined by sunrise and sunset times for the location of the traffic lights.

BRIEF DESCRIPTION OF THE DRAWING

The foregoing and other objects, features and advantages of the invention will become more readily apparent upon reference to the following detailed description of the preferred embodiment, when taken in conjunction with the accompanying drawing in which like numbers refer to like parts.

DETAILED DESCRIPTION OF THE PREFERRED EMBODIMENT

In accordance with the present invention, an apparatus is shown for reducing the voltage applied to traffic signal lights during nightime operating hours to effect substantial savings in energy consumption thereby. It is appreciated that the disclosed apparatus, or similar, moderately varied versions thereof, may be used in other applications, including but not limited to control of motors, lighting, assembly line devices, power distribution, and the like.

Figure 1:
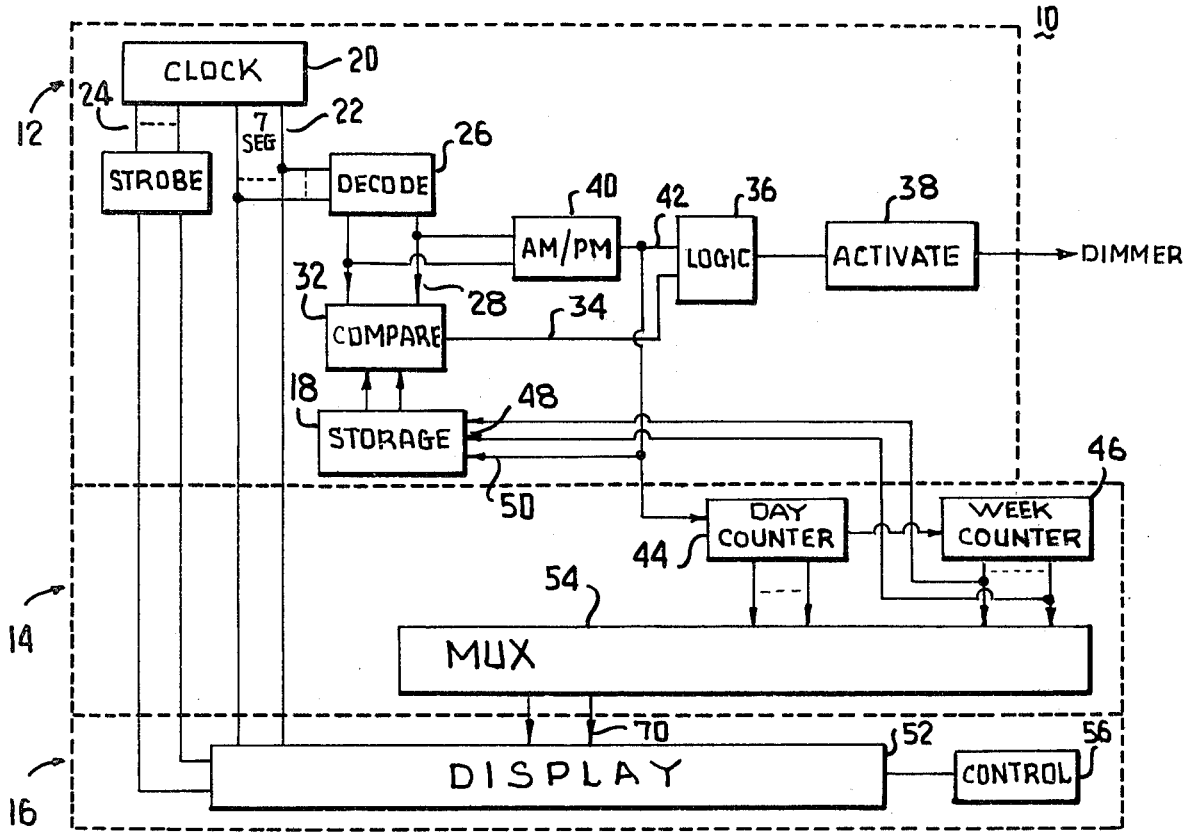
FIG. 1 shows the inventive circuit in generalized block diagram form.

Referring now to FIG. 1, the present embodiment of the invention is generally shown at 10. As seen therein, the invention is comprised of three basic portions.

A first portion, identified by reference numeral 12, includes therein the various timekeeping devices, storage devices, comparison and logic circuitry, and activating circuitry for the dimming device. A second portion, identified by reference numeral 14, includes the day and weeks counters used in the invention, as well as a multiplexing arrangement for the outputs thereof. Finally, a third portion, identified by reference numeral 16, includes a display apparatus, receiving the output of the multiplexing arrangement and of the clock mechanism for display, and a control means therefor.

Referring to the first portion 12, a storage device 18 is provided for storing time data, or schedules, for activating or deactivating a dimming device for the lights to be controlled.

A clock 20 is provided for keeping present time, the clock providing outputs on lines 22, containing the time data, and on lines 24, containing control data. The time output data on lines 22 is provided in seven-segment format, for display on seven-segment display devices. A strobe generator circuit 25 uses the control signals to provide strobe signals to the display. A decoding circuit 26 is provided for converting the seven-segment data on lines 22 to BCD (binary coded decimal) format, for use in comparison and other computation functions.

The decoded present time data, provided on output lines 28 of decoding circuit 26, is compared with the stored schedule data from storage device 18, provided on output lines 30 thereof. The comparison of the present time with the stored time data is made in a comparator 32, providing an output on line 34 indicative of whether present clock time is greater or less than the time output from storage device 18.

A logic device 36 receives the output of comparator 32 and, responsive thereto, operates an activating circuit 38 for a dimmer (not shown). Inasmuch as a comparison transition from a "less than" comparator output to a "greater than" output is indicative that the present time has passed the scheduled point of activation, but is not indicative of whether the activation should be energization or deenergization of the dimmer, additional information is provided to the logic device for deciding on the appropriate response to the transition.

An AM/PM circuit 40, responding to the decoded time output by decoding circuit 26, provides an indication on output line 42 of the particular time segment (AM or PM) identifying the present time. Logic device 36, determining that comparator 32 has undergone a transition during an AM interval, thus provides an output to activating circuit 38 indicating that the dimmer should be deactivated, in order to provide full lighting intensity during daytime. On the other hand, when logic device 36 determines that the transition of comparator 32 occurs during a PM interval, the output signal provided thereby is used to cause activating circuit 38 to activate the dimmer, thereby reducing the light intensity during the evening and night hours, and providing the desired saving in energy dissipated by the controlled traffic light.

The data stored in storage device 18 thus need not include any control data (i.e., "activate" or "deactivate") information, but need only include comparison times representative of sunrise and sunset, for example. Such control data may be stored, however, along with the desired comparison times, in which case the logic device 36 may be replaced by a decoding circuit to provide the appropriate output to activating circuit 38 in response to the appropriate stored control data.

It is appreciated that actual dimming and brightening times for the controlled traffic light devices need not coincide with sunset and sunrise. These control times may, in fact, provide for dimming the lights a particular time increment after sunset, and may provide for brightening the lights a similar time increment prior to sunrise. Moreover, it is understood that where other devices are to be controlled by the present invention, the times for activating and deactivating the power reduction device need not have any relationship with times for sunrise or sunset. Any desired time scheduling may be used. However, for simplicity and consistency in language herein, the terms sunrise and sunset continue to be used to indicate the stored times in storage device 18 for deactivating and activating the power reduction device.

Further, in such other applications not related to sunrise and sunset times, it may be more convenient to determine other time segments than AM or PM times. For example, where one control signal (e.g., activate power reduction device) is typically given in a first time segment, such as 3:30 PM to 10:00 PM, and the other control signal (e.g., deactivate power reduction device)) is typically given in a second time segment, such as 10:01 PM to 3:29 PM, then AM/PM circuit 40 may be replaced by a detector for the output of decoding circuit 26. The detector need only provide a first signal during the first time segment, and a second signal during the second time segment, for instructing logic device 36 on how to respond to the determination that a transition has occurred in the output of comparator 32.

It is an advantage of the present invention that a schedule of non repetitive times for activating or deactivating any device may be stored. The schedule may cover an arbitrarily long time period, such as a year, for example. A year is a particularly appropriate time period for light dimming devices, inasmuch as sunrise and sunset times vary at a yearly repetition rate. For the specific preferred embodiment, wherein traffic control lights are dimmed during the night-time hours, it is known that sunrise and sunset times vary relatively slowly, and that for predetermined periods of time they may be considered to be relatively constant. Particularly, it is known that the changes in sunrise and sunset times over any one-week period are typically limited to a few minutes at most.

As a savings in storage requirements, the present invention accordingly stores the activating and deactivating schedule in terms of the selected time periods where such schedule times vary by the above mentioned few minutes. That is, only weekly sunrise-sunset time schedules are stored in storage device 18.

Whether the time period during which the stored schedule may be considered to remain substantially constant is a week or any other period, however, apparatus is provided for counting such periods, in order to address the particular data in storage corresponding to the particular present period. In the present preferred embodiment, second portion 14 is seen to include a day counter 44 and a weeks counter 46, the output of the weeks counter being used to address storage device 18 at its address inputs 48. The day counter is triggered by detection of transition of AM/PM circuit 40 to an AM output. Accumulation of a count of seven days in day counter 44 is used to cause weeks counter 46 to increment its count by one.

Thus, for any day within a particular week, the sunrise/sunset schedule for that day is obtained from a location within storage device 18 which is addressed by the contents of weeks counter 46. The embodiment of FIG. 1 further provides for obtaining the particular time for comparison (i.e., sunrise or sunset) from the storage device by a further address input 50, receiving the output of AM/PM circuit 40.

The appropriate comparison time is thus obtained by a combined address, formed of the week number and an indication of AM or PM time segment, compared with present time in comparator 32, and appropriate action taken by logic device 36 in accordance with the AM or PM status.

For convenience of the user, the present invention includes a display 52, for displaying the present time, the contents of the day counter, and the contents of the week counter. A multiplexing arrangement, shown as multiplexer 54, is used to provide the contents of counters 44 and 46 to the display. A control 56 is provided for controlling display 52, in order to display the contents of clock 20 or counters 44 and 46.

Figure 4:
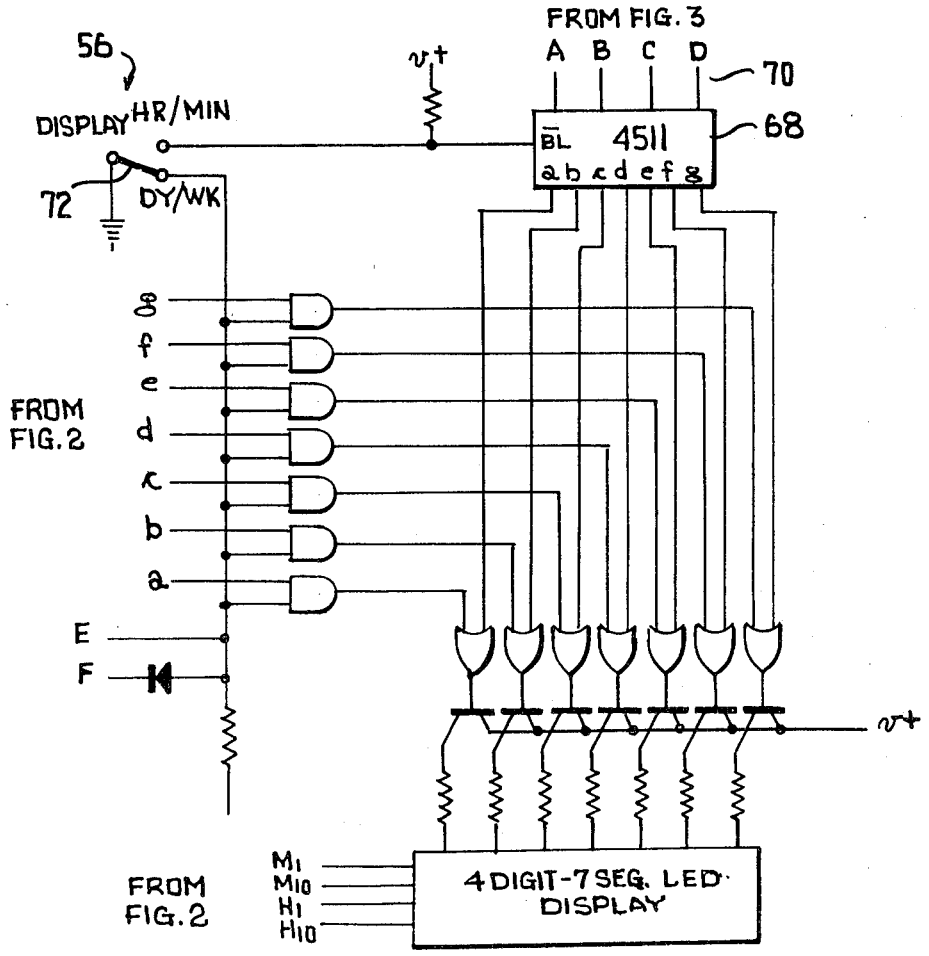
FIG. 4 shows the display portion of the invention, along with a switching arrangement for displaying the time or the contents of the day and week counters thereon.
Figure 2:
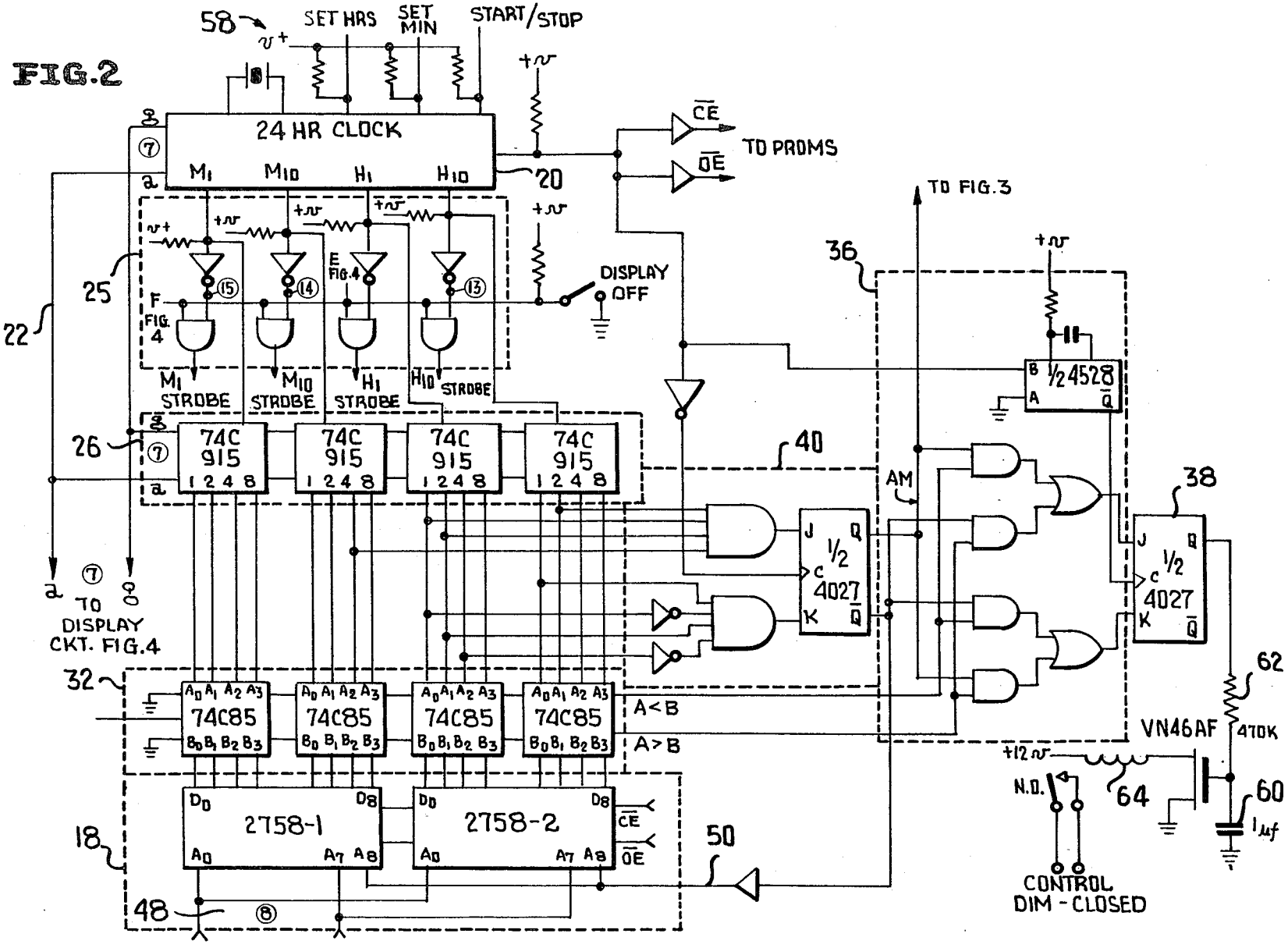
FIG. 2 shows a portion of the actual circuitry used to realize the embodiment of FIG. 1, in schematic representation.
Figure 3:
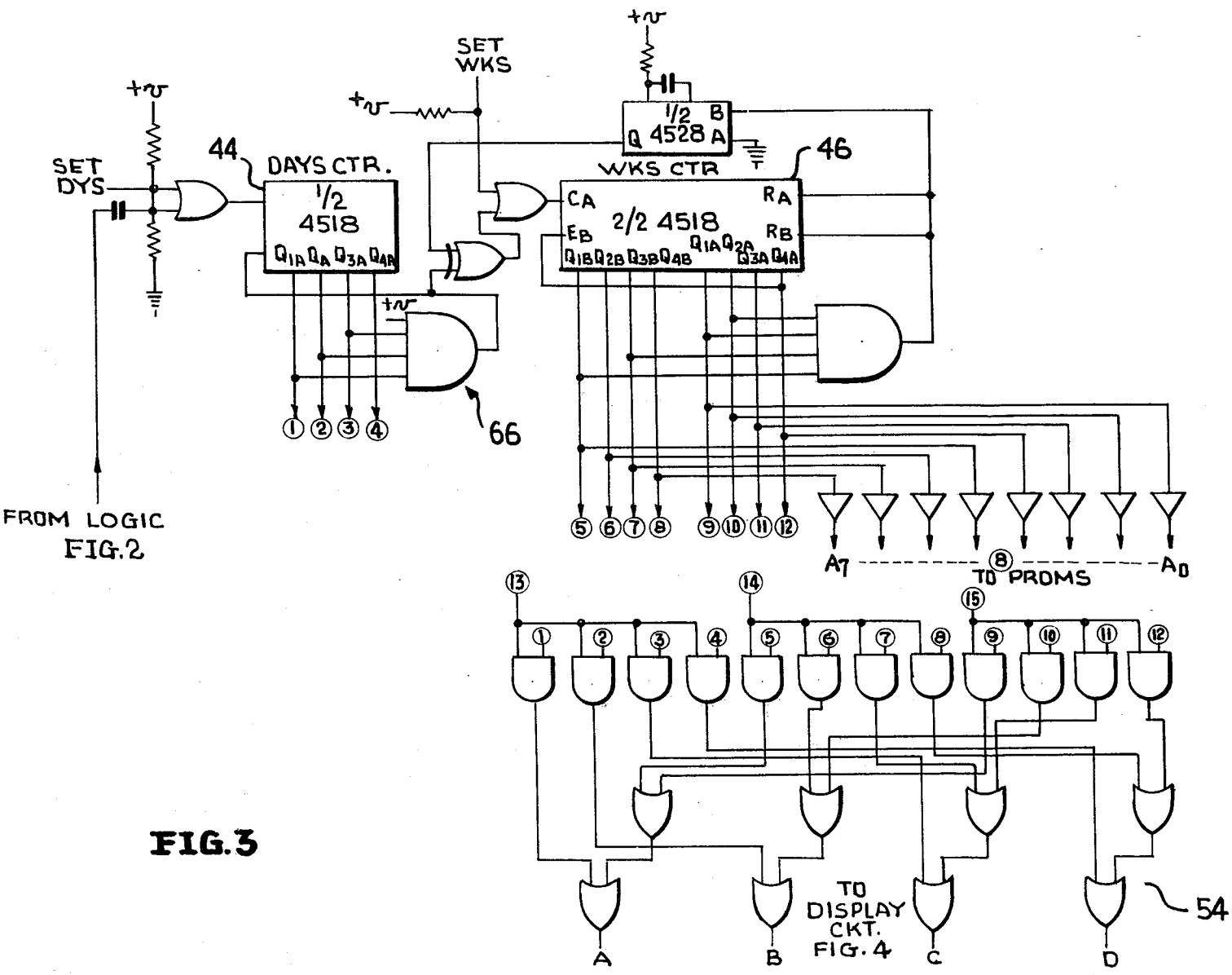
FIG. 3 shows a further portion of the embodiment of FIG. 1, including the counters for days and weeks and a multiplexing arrangement therefor.

Referring now to FIGS. 2–4, the detailed structure of the present invention is shown in terms of specific interconnections of commonly available circuit chips. As shown in FIG. 2, clock 20 is comprised of a 24 hour clock chip of the type 7045, timed by a quartz crystal 58, which supplies multiplexed, seven-segment encoded hour/minute information together with five digit strobes. Four of the strobes are used to excite the four-digit, seven segment display of FIG. 4 and for latching digit information into decoding circuit 26, formed of four seven-segment to BCD decoders of the type 74C915. A fifth strobe is used as a system trigger for proper timing of comparison and control functions.

The strobe signals are processed by strobe generator circuit 25, formed of a plurality of NAND gates receiving one input from an inverting amplifier at the output of the clock chip and a second input from a control switch for deactivating the display.

The schedule of morning and evening twilight data, ordered by week from 1 to 52, is stored in a pair of programmable read only memory chips of the type 2758. The information is arranged within the PROMS as follows. Locations 1 through 52 contain the sunrise information, by week, and locations 101 through 152 include sunset information, by week.

The AM/PM circuit 40 is seen to decode the BCD time information, output by the seven segment to BCD decoding circuit 26, by setting a flip flop (type 4027, for example) in response to a time of 23 hours, 40 minutes and resetting the flip flop at 12 hours, 0 minutes. The setting of the flip flop at 23 hours 40 minutes, instead of at 0 hours, 0 minutes, is chosen for hardware and space limitations, and does not affect operation of the circuit inasmuch as none of the stored times are in the range of 11:40 PM to midnight.

The outputs of the decoding circuit 26 and the PROMs are compared in comparator 32, formed of four 4-bit comparators of the type 74C85. The results of the comparison, along with AM and PM outputs of circuit 40, are provided to logic device 36, formed of a number of AND and OR gates connected to set and reset a second 4027 flip flop. As will be appreciated by those skilled in the art, logic device 36 sets flip flop 4027, which forms activating circuit 38, when the output of circuit 40 indicates an AM situation and the present time is less than the stored (sunrise) time, or when the output of circuit 40 indicates a PM time and the present time is greater than the stored (sunset) time. Alternatively, activating circuit 38 is reset when it is AM and the present time is greater than the stored time, or when the present time is less than the stored (sunset) time and the output of circuit 40 indicates PM. The output of activating circuit 38 provides a signal to a low pass circuit, formed of a capacitor 60 and a resistor 62, and then to a relay for energizing the dim control circuit.

The multiplex rate of the clock is approximately 100 Hz, which is also used as the rate for comparisons and logical decisions in the inventive circuit. Provision of the low pass circuitry is advantageous in filtering out any faulty comparisons, which are made at the 100 Hz rate, prior to activating the energizing relay 64 for the dim-control circuit, thus correcting errors prior to displaying the results of such errors.

A transition in the output of AM/PM circuit 40 from PM to AM is used to cause day counter 44, formed of one half a 4518 counter, to count an additional day, as seen in FIG. 3. Upon reaching a count of seven days, gating circuitry 66 is used to cause weeks counter 46, formed of a 4518 counter as well, to advance its count.

As seen in FIG. 2, the eight outputs of weeks counter 46 are used to address eight of the input address lines of the PROMs used for storage device 18. The ninth address line is addressed by the PM output line of AM/PM circuit 40. The combined address inputs thus access locations 1–52 and 101–152, as previously described, and provide the appropriate stored time information (sunrise or sunset) for comparison with the appropriate present time segment (AM or PM, respectively).

Referring once again to FIG. 3, multiplexer 54 is seen to be formed of a plurality of AND and OR gates to provide a single set of four BCD outputs from three input sets of four BCD inputs, each. Referring now to FIG. 4, the four multiplexed BCD outputs from FIG. 3 are seen to be input to a BCD to seven-segment decoder 68, formed of a 4511 chip. The inputs are provided at 70. As is also seen from the Figures, the seven-segment clock outputs at 22 are also input to the display, to a plurality of enabling AND gates each having one input connected to control 56. Control 56 comprises a switch 72 for grounding and disabling the AND gates, thereby passing the output of BCD to 7 segment decoder 68 for display. Alternatively, the switch may be used to disable the decoder 68, and to pass the output signals from clock 20 for display.

The output signals from strobe generator circuit 25 are used to strobe the appropriate one of the four digits in the display, thus providing either the time (in hours and minutes) of the day and week count for display in the apparatus.

It is appreciated that the above described preferred embodiment may also be realized using a single chip microprocessor to implement the timekeeping, comparison, storage and display maintenance functions similarly to the above described structure. Moreover, in terms of the schedules of twilight times, sunrise and sunsets, and the like, stored in the circuit, it is known that such schedules are a function of the geographical latitude of the observer. Accordingly, it is contemplated that complete tables of sunrise and sunset times may be stored permitting accessing or computation of precise twilight times for any number of latitudes. One contemplated approach is to provide tables encompassing the latitudes from zero to 63° north and south, as well as tables varying by one degree increments of longitude within a time zone.

In order to assure long term accuracy of clock output, the timekeeping function preferrably is connected to operate with a power supply from standard 50 Hz or 60 Hz AC power, and with a quartz reference when line power is not available. Backup battery power is to be provided for operation during interruptions in line power.

The preceding specification describes the preferred embodiment of the invention as an illustration and not a limitation thereof. It is appreciated that equivalent variations and modifications of the invention will occur to those skilled in the art. Such modifications, variations and equivalents are within the scope of the invention as recited with greater particularity in the appended claims, when interpreted to obtain the benefits of all equivalents to which the invention is fairly and legally entitled.

What is claimed is:

1. Control apparatus for reducing power supplied to utilization devices comprising:
   (a) storage means for storing particular times for providing said reduced power;
   (b) time keeping means for determining present time;
   (c) comparing means for comparing present time with said stored times for providing said reduced power; and
   (d) activating means responsive to said comparing means for providing appropriate power to said lighting devices.

2. Control apparatus according to claim 1 wherein said storage means comprise a plurality of storage locations corresponding to a plurality of time periods each including a number of days having substantially similar sunrise and sunset times, each storage location storing sunrise or sunset time for a particular one of said time periods.

3. Control apparatus according to claim 2 wherein said utilization devices comprise lighting devices.

4. Control apparatus according to claim 3 wherein said time periods comprise weeks, said plurality of storage locations including bit configurations representative of weekly sunrise and sunset times for a particular geographic location, said storage means further comprising addressing means for addressing said storage locations.

5. Control apparatus according to claim 4 further comprising day counting means and week counting means, for counting days and weeks, respectively, and for addressing said storage means, and display means for displaying said present time, said day count and said week counts.

6. Control apparatus according to claim 2 further comprising means for counting said time periods for addressing said storage locations.

7. Control apparatus according to claim 6 further comprising means responsive to said time keeping means means for generating a signal indicative of particular time segments.

8. Control apparatus according to claim 7 wherein:
   said time segments comprise ante-meridian and post-meridian times;
   said storage means comprises addressing means for addressing said storage locations for said sunrise and sunset times for a particular one of said time periods, including
   means responsive to said ante-meridian and post-meridian signal for addressing a selected one of said sunrise or said sunset times for said particular time period.

9. Control apparatus according to claim 8 wherein said comparing means provides a signal indicative of a comparison of present time with said selected one of said sunrise or sunset times addressed by said ante-meridian and post-meridian signal.

10. Control apparatus according to claim 9 wherein said activating means includes logic means responsive to said signal indicative of said comparison and to said ante-meridian and post-meridian signal for reacting to a result of said comparison differently for ante-meridian times and for post-meridian times.

11. Control apparatus according to claim 10 wherein said activating means comprises flip flop means for operating a relay to activate a control means for reducing power to said utilization device.

12. Control apparatus according to claim 11 further comprising display means for displaying the count of said means for counting said time periods and the time kept by said time keeping means.

13. Control apparatus according to claim 12 further comprising multiplexing means for displaying said count and said time on a single display.

14. A method for providing controls for application of power to utilization devices comprising the steps of:
   (a) storing a table of individual times for applying said control during one of a plurality of time segments of individual days and for removing said control during another of said time segments of said individual days;
   (b) counting individual days for addressing said stored table to obtain said individual times;
   (c) in a comparing means, comparing present time in an individual day with individual times obtained from said stored table;
   (d) responding in a logic means to said comparison by applying or removing said control for application of power to said utilization devices; and
   (e) providing a signal indicative of the present time segment to said logic means for causing said logic means to apply said control in one of said time segments and to remove said control in another of said time segments.

15. The method according to claim 14 further comprising the step of counting periods of said individual days, wherein:
   said storing step comprises the step of storing times for applying said control and for removing said control for periods of said individual days;
   whereby the tables stored in said storing step are reduced in quantities of data stored therein.

16. The method according to claim 14 wherein said storing step comprises the step of storing a table of individual times for particular geographic locations.

17. The method according to claim 14 wherein said comparing step comprises the steps of computing time data for particular geographic locations from the individual times in said stored table, and comparing present time in an individual day with the computed time data for a particular geographic location.

* * * * *